United States Patent [19]

Stefano et al.

[11] Patent Number: 4,763,818

[45] Date of Patent: Aug. 16, 1988

[54] REMOVABLE HYGIENIC HAND PUMP ADAPTER FOR DISPENSING LIQUIDS

[76] Inventors: Alfonso D. Stefano, 1413 Wayburn Rd., Grosse Pointe Park, Mich. 48230; Gerald A. Farber, 23227 Clairwood, St. Clair Shores, Mich. 48080

[21] Appl. No.: 12,009

[22] Filed: Feb. 6, 1987

[51] Int. Cl.[4] ..... B65D 83/14

[52] U.S. Cl. ..... 222/209; 222/210; 222/323; 222/386.5; 222/389; 222/401

[58] Field of Search ..... 222/209, 210, 323, 386.5, 222/389, 401

[56] References Cited

U.S. PATENT DOCUMENTS

| | | | |
|---|---|---|---|
| 141,844 | 8/1873 | White . | |
| 878,389 | 2/1908 | Henry . | |
| 2,612,297 | 9/1952 | Bain | 222/401 |
| 2,673,013 | 3/1954 | Hester | 222/386.5 |
| 3,275,197 | 9/1966 | Eklund | 222/195 |
| 3,300,102 | 1/1967 | Budzich | 222/386.5 |
| 3,796,356 | 3/1974 | Venus, Jr. | 222/212 |
| 3,876,115 | 4/1975 | Venus, Jr. et al. | 222/183 |
| 3,877,614 | 4/1975 | Murphy | 222/209 |
| 3,940,026 | 2/1976 | Kain | 222/212 |
| 3,987,938 | 10/1976 | Cooprider et al. | 222/209 |
| 4,147,278 | 4/1979 | Uhlig | 222/94 |
| 4,239,132 | 12/1980 | Mueller et al. | 222/212 |
| 4,383,622 | 5/1983 | Guth | 222/209 |
| 4,386,929 | 6/1983 | Peery et al. | 604/132 |
| 4,458,830 | 7/1984 | Werding | 222/131 |
| 4,535,918 | 8/1985 | Heiligman et al. | 222/185 |

FOREIGN PATENT DOCUMENTS

| | | | |
|---|---|---|---|
| 628541 | 6/1927 | France | 222/401 |

*Primary Examiner*—Joseph J. Rolla
*Assistant Examiner*—Frederick R. Handren
*Attorney, Agent, or Firm*—Cullen, Sloman, Cantor, Grauer, Scott & Rutherford

[57] ABSTRACT

A removable hygienic hand pump adapter or adapter mechanism for dispensing liquids or semi-liquids from a container comprises a body having a bore and of a shape to fit around a container with a neck. A hand pump on the body includes a manually flexible outer wall defining an air chamber. A cover assembly upon the body has a cap portion snugly positioned over the neck and has an outlet. An extension tube which is integral with the cap portion extends into the container. A flexible collapsed bladder is mounted at its neck around the tube, extends along the tube and is adapted to expand along the interior of the container upon application of pressurized air from the pump to progressively dispense all the contents of the container.

12 Claims, 2 Drawing Sheets

REMOVABLE HYGIENIC HAND PUMP ADAPTER FOR DISPENSING LIQUIDS

FIELD OF THE INVENTION

The present invention relates to a hygienic hand pump adapter mechanism for dispensing liquids including semi-viscous liquids from a container. The adaptor mechanism employs an inflatable bladder positioned within the container which, on application of pressurized air thereto, expands axially along the interior of the container to forcibly dispense all of the liquids progressively through the container outlet.

BACKGROUND OF THE INVENTION

In the dispensing of liquids and semi-liquids such as viscous liquids or thick liquids, including catsup, mustard, salad dressing, or other food products or medicinal products, there has been the difficulty of effectively and in a sanitary manner forcibly dispensing all of the liquids from the container outlet. With containers of this type and in the attempted dispensing thereof, some of the liquids remain within the container and are wasted.

Previously, a flexible balloon has been used within a container for propelling the contents from the outlet thereof. However, difficulties have been encountered in controlling the flow of pressurized air into and out of the balloon such that upon release of pressure from the pump mechanism, the dispensed liquids return to the container. In addition, the prior art devices using air pumps have resulted in some air contamination of the liquids being dispensed.

SUMMARY OF THE INVENTION

An important feature of the present invention is to provide a removable hygienic hand pump adapter mechanism including an inflatable bladder for dispensing liquids and semi-liquids from a container or bottle and wherein there is provided a body having a bore of a shape to fit around a container and having a neck with a hand pump on the body including a manually flexible outer wall defining an air chamber for the pump.

Another feature includes a cover assembly upon the body including an apertured cap portion which is snugly positioned and secured over the container neck and which includes a dispensing outlet communicating with the neck together with an extension tube which depends from the cap portion axially into the container and has an outlet spaced from the bottom thereof.

Still another feature includes a flexible collapsed inflatable bladder which is mounted and sealed at its neck around the extension tube and extends along the tube and is adapted on application of air pressure from the pump to expand from the bottom of the container along the interior thereof to forcibly dispense all of the liquids progressively through the outlet.

A further feature provides a bladder with air conduit connections to an air pump upon the body of the adapter and wherein the pressurized air is at all times separated from the liquid to be dispensed to prevent contamination thereof.

A still further feature includes, in conjunction with the air pump, normally closed air valve means on the body which communicate with the air chamber for controlling the flow of atmospheric air into the chamber and the flow of pressurized air outwardly of the chamber and into the expandable bladder.

Another feaure includes the construction of a bladder in the form of a balloon which when deflated is of cylindrical form and has a neck portion which is sealed over the upper end portion of the extension tube, extends along its length and outwardly thereof and wherein the bladder walls are of decreasing thickness towards its outer end in order to facilitate expansion of the bladder along the interior walls of the container and axially from the bottom thereof.

Still another feature includes within the cap portion of the adapter mechanism an axial threaded bore and an apertured plug threaded into the threaded bore whereby upon retraction of the apertured plug pressurized air from the bladder can be permitted to escape relieving pressure from the stored liquids within the container and further to selectively facilitate refilling of the container with liquids and semi-liquids through its dispenser outlet.

A further feature contemplates that the use of the present hygienic adapter mechanism with a bottle constructed of glass. In such a construction, the adapter is mounted with a cup shaped extension depending from the body of the adapter to supportably receive a bottom portion of the bottle.

These and other objects and features will be seen from the following specification and claims in conjunction with the appended drawings.

THE DRAWINGS

Figure 2:
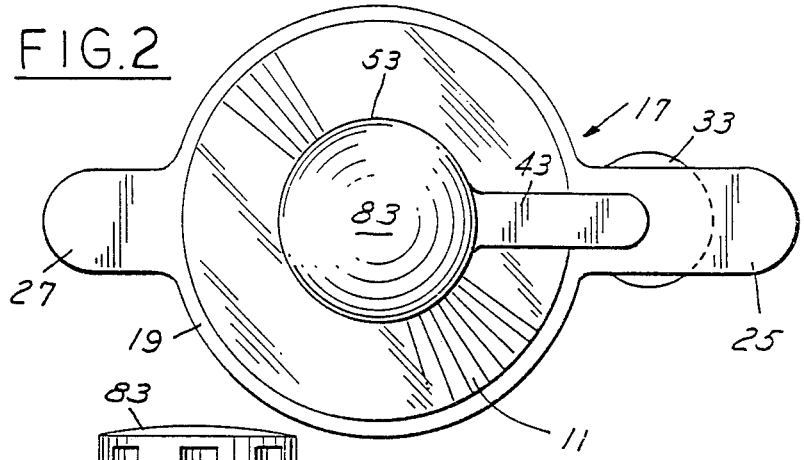
FIG. 2 is a top plan view of the hand pump adapter of FIG. 1.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Referring to the drawings, FIGS. 1 through 4, there is shown a container or bottle 11 preferably of plastic material, but which under some circumstances could be constructed of glass, adapted for the storage and dispensing of liquids, semi-liquids or substances 13. These liquids 13 may be food products or medicinal products and include such viscous liquids as catsup, mustard, salad dressing or the like. The container includes at one end a threaded neck 15, FIG. 3.

Figure 1:
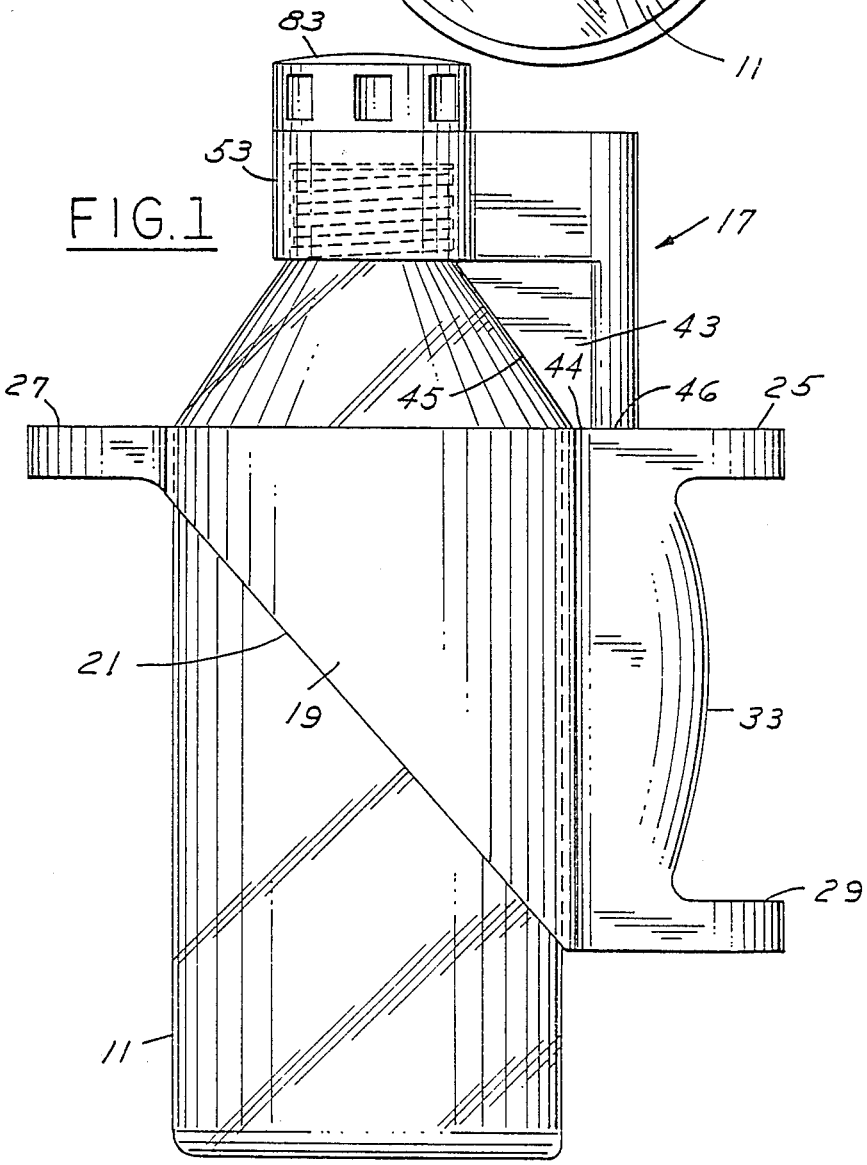
FIG. 1 is a side elevational view of the present removable hygienic hand pump adapter as mounted upon a container containing a liquid or semi-liquid for dispensing therefrom.
Figure 4:
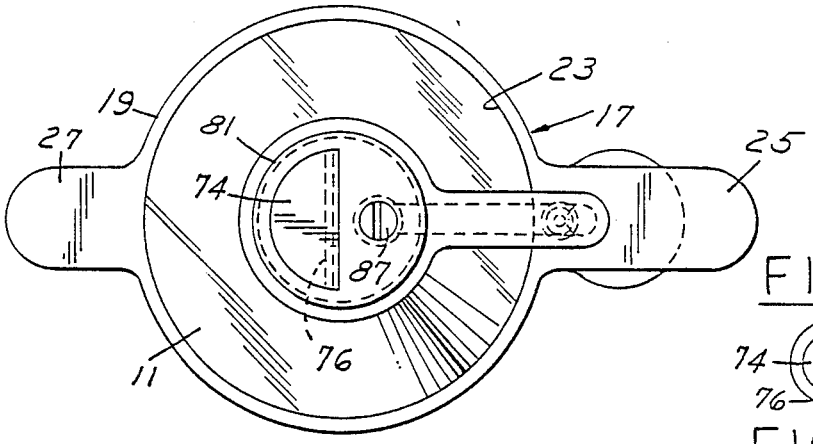
FIG. 4 is a top plan view of the hand pump adapter with the cap removed.
Figure 7:
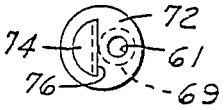
FIG. 7 is a plan view of the bladder illustrated in FIG. 6.

The present hygienic hand pump adapter or adapter mechanism is generally indicated at 17, and includes a body 19 of annular form shaped as shown at 21 upon its opposite sides in order to conform to and to partly enclose the bottle or container 11, FIG. 1. Body 19 has a bore 23 adapted to cooperatively receive upper portions of container 11. The body 19 at its upper end has a pair of laterally opposed top handles 25 and 27 of reduced width as compared to the diameter of body 19, FIGS. 2 and 4, and a single bottom handle 29 spaced from and aligned with the top handle 25.

Body 19 includes between handles 25 and 29 the connector wall 31 which, with the manually flexible convex wall 33, defines the present hand pump as a part of the hand pump adapter mechanism 17. The hand pump includes air chamber 35 which is normally closed by the normally seated valve or ball check valve 37 in communication with atmospheric air inlet 39. The pump further includes the normally closed air outlet valve 41 in the form of a ball check valve, FIG. 3.

Overlying body 19 and forming a part of the pump adapter mechanism 17 is the cover assembly 43 having an elongated body portion which extends upwardly of handle 25 and substantially overlies the pump assembly 31, 33, and 35. The cover assembly 43 has an internal tapered surface at 45, FIG. 3 to correspond to the conventional taper at the upper end of container 11 adjacent its threaded neck 15. The body 19 and cover assembly 43 have surfaces 44 and 46 respectively which abut when the parts are assembled as shown in FIG. 3.

Cover assembly 43 includes a tubular portion 47 which snugly projects into bore 49 formed within body 19 and is in communication with air chamber 35. Tubular portion 47 is snugly positioned within bore 49 and secured therein by suitable adhesive or by a pressure assembly. Cover assembly 43 includes air passageway 51 which at one end communicates with air chamber 35 when air valve 41 is lifted from the position shown in FIG. 3.

Figure 3:
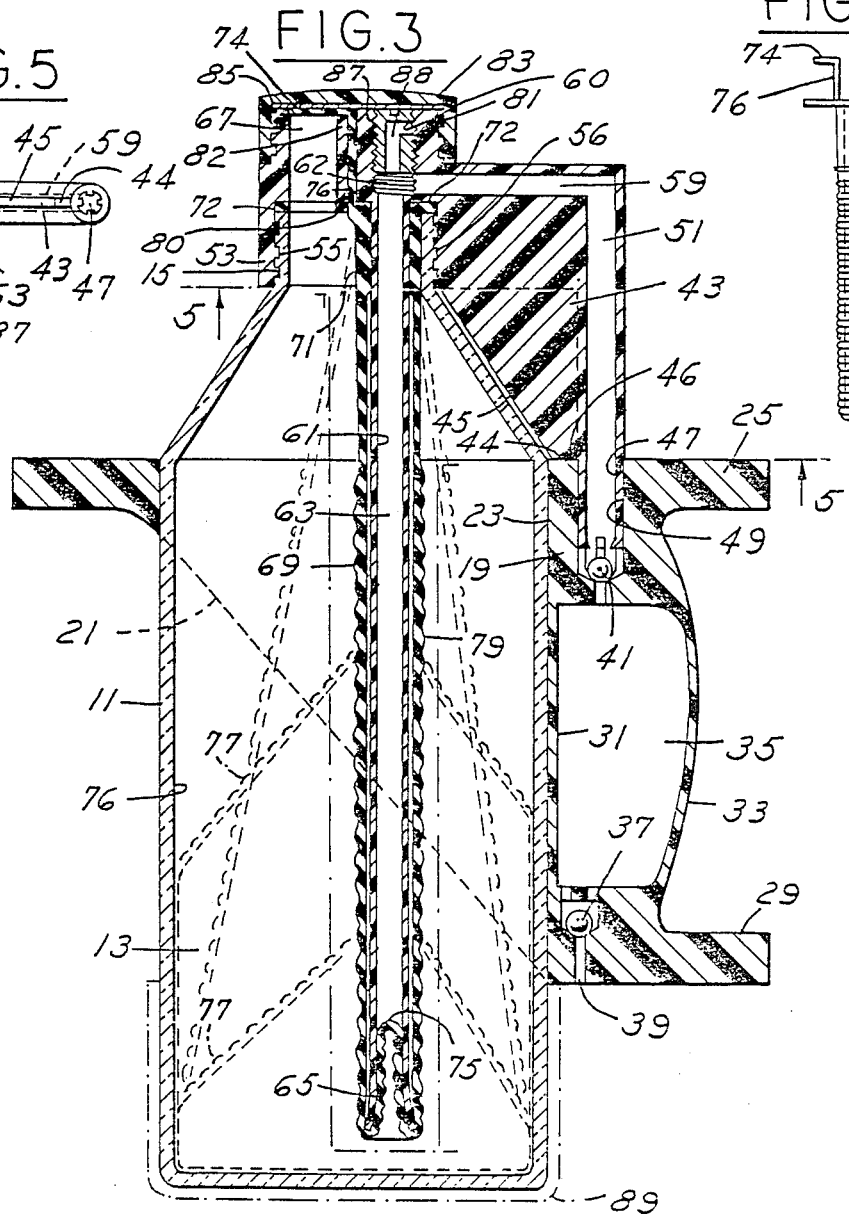
FIG. 3 is a longitudinal section of the hand pump adapter and container shown in FIG. 1.

Cover assembly 43 includes apertured cap portion 53 which is interiorly threaded at 55 and fits over the threads 56 provided on neck 15, FIG. 3. The cover assembly 43 includes transverse air passage 59 which communicates with air passage 51 and at its inner and extends into the cap portion 53.

The elongated extension tube 61 is integrally made with the cap portion 53 and is thus a part of the cap portion 53. The tube 61 extends axially downward throughout substantially the height of container 11. The tube 61 has a longitudinal bore 63 and terminates in an outwardly flared portion 65 adjacent to and spaced from the bottom container 11, FIG. 3. Bore 63 communicates with passages 59, 51 and 60. Passage 60 is threaded at 62 and is axially aligned with tube passage or bore 63, FIG. 3.

The upright dispensing outlet 67 is formed axially through cap portion 53 and is in communication with the interior of neck 15. The expandable, flexible bladder or balloon 69 surround extension tube 61 and may, as an example, have its upper end suitably secured to the tube 61 as by an adhesive, cement or otherwise. The bladder 69 extends around and loosely along the outer surface of the tube 61 and normally projects below extension tube 61. Viewed in FIG. 3, anchor portion 71 of bladder 69 is of maximum thickness. The bladder or balloon 69 has an annular rim 72 which is interposed or retained between the cap portion 53 and the top of the bottle neck as shown in FIG. 3.

The bladder 69 includes an integral inverted L-shaped flexible sealing closure flap 74. The flap 74, which has a vertical leg 76, forms a flexible horizontal closure for outlet 67. The leg 76 is integral with the anchor portion 71 of bladder 69.

The apertured cap portion 53 is provided with an opening 80 in sleeve 82 which receives and retains the vertical leg 76 and the flap 74 in their normal relationship with respect to the outlet 67. The flap 74 opens when the pump is actuated to permit the liquids to be dispensed through outlet 67.

Figure 6:
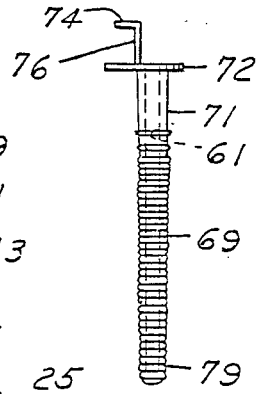
FIG. 6 is a front elevational view of the bladder, on a reduced scale.
Figure 5:
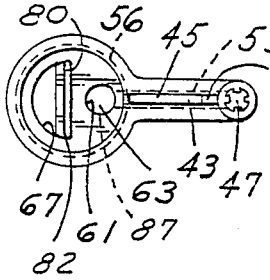
FIG. 5 is a bottom view, of the cover assembly of the hand pump adapter, on a reduced scale, with the container, bladder and pump removed, and looking in the direction of arrows 5—5 of FIG. 3.

An important feature is that the bladder or balloon 69 is of gradually decreasing thickness towards its lower end as shown in FIGS. 3 and 6. This is so that upon application of pressurized air from the pump air chamber 35 and through the passages 51, 59 and bore 63, the bladder 69 will expand laterally along the interior surfaces 76 of the container 11 and upwardly progressively as shown by the dash lines, FIG. 3.

Continued application of pressurized air from the pump 33–35 to the bladder 69 will ultimately cause further upward expansion of the bladder 69 until progressively all of the liquid or semi-liquid contents 13 have been forcibly dispensed through outlet 67. The liquid which is dispensed forces the closure flap 74 out of the container 11. After the liquid is dispensed, the closure flap 74 is returned to the interior therby closing the outlet 67 and assuming the position of FIG. 3.

As shown in FIG. 3 and with the bladder or balloon 69 uninflated, its end portion 75 is reverse folded and nested within tube 61 extending upwardly thereof a short distance adjacent its flared portion 65 at its lower end of the tube.

The collapsible bladder 69 is shown partly expanded at 77, FIG. 3, upon the application of pressurized air from the pump 31, 33 and 35 which is directed through the air passages 51 and 59 and 63 into the bladder 69. In the illustrative embodiment the bladder 69 has annular corrugations 79 along its length to improve its strength and resiliency.

The cap portion 53 which forms a part of the cover assembly 43 has a threaded upper end 81 over which is threaded the closure cap 83 with gasket 85 interposed therein. The gasket 85 engages the flap 74 for normally closing off the dispensing outlet 67. Located within the threaded passage 62 of cap portion 53 adjacent its upper end is an air pressure release screw threaded plug 87 which has an axial aperture 88 therein whereby with cap 83 removed and upon partial unthreading of plug 87, inflated bladder 69 may be permitted to collapse with the pressurized air therein escaping through bore 63, threaded passage 62 and out through the axial aperture 88 provided in the screw threaded plug 87.

In most situations, the present container or bottle 11 will be constructed of a plastic material. In those situations where the container 11 is constructed of glass, the present hygienic hand pump adapter mechanism includes the depending cup extension 89, FIG. 3, which extends below bottom handle 29 and is adapted to cooperatively and supportably receive the bottom portion of container 11.

The present removable hygienic hand pump adapter mechanism 17 may be employed as a reusable non-wasteful substance dispensing device. There is provided a unique hygienic and safe method of dispensing food in liquid or semi-liquid form or other materials including medicines, with no substance loss and no air contamination or with any substance being trapped within the container.

Through the use of the hand pump 33–35, FIG. 3, pressurized air is pumped from chamber 35 into the bladder 69. The bladder 69 is constructed of various thicknesses and which expands to the inside wall 76 of the container 11 from the bottom of the container 11 upwardly. As more air is pumped into the bladder 69 the contained substance 13 is forced up and out of the container 11 regardless of its position. Accordingly, all of the contents without any contamination, are dispensed through outlet 67. No materials or substances as at 13 are left unobtainable at the bottom or sides of the container 11.

The pressure release valve 87–88 when partly retracted from the position shown in FIG. 3, allows the pressurized air within the bladder 69 to be released when not in use for safe storage. This feature may also be used as a refilling technique. By connecting a tube from a master container and releasing the bladder pressure, substance is drawn into the dispensing device through outlet 67 thereby eliminating waste and contamination. Specifically, to refill the container 11 and with air pressure relieved by elevation of the valve 87–88 from the position shown in FIG. 3, a tube (not shown) is inserted into opening 67 and extends between container 11 and a container or source of liquid. As the balloon deflates with the exhausting of air additional liquid is sucked into the container 11 through the tube (not shown) and opening 67.

The balloon or bladder 69 is of a unique design in that its walls are thinner at the bottom and increase in thickness from the bottom to the top, FIGS. 3 and 6. The purpose of this is to permit its expansion first at the bottom of the bladder 69 against the container inner walls and expand upwardly from the bottom to the top. The bladder 69 may be constructed of rubber, latex or other equivalent plastic material. Having described our invention, reference should now be had to the following claims:

We claim:

1. A removable hygienic and hand pump adapter mechanism including an inflatable bladder for dispensing liquids and semi-liquids from a container or bottle comprising a body having a bore and of a shape to surround the sidewalls of a container having a neck;

a hand pump on said body including a manually flexible outer wall defining with said body an air chamber;

a cover assembly upon said body including an apertured cap portion to be snugly positioned and secured over said neck and including a dispensing outlet for communicating with said neck;

an extension tube depending from said cap portion for extending axially into said container having an outlet to be spaced from the bottom of said container;

there being an air passage in said cover assembly at its ends communicating with said air chambers and said tube respectively; and a flexible collapsed inflatable bladder mounted and sealed at its neck around said tube and extending along said tube adapted on application of air pressure from the pump to expand from the bottom of the container along the interior thereof to forcibly dispense all the liquids progressively through said outlet, said bladder preventing air contamination of said liquids.

2. In the hand pump adapter mechanism of claim 1, normally closed air valve means on said body communicating with said air chamber for controlling flow of atmospheric air into said chamber and pressurized air outwardly of said chamber.

3. In the hand pump adapter mechanism of claim 1, said cap portion being interiorly threaded for engagement with threads on the container neck.

4. In the hand pump adapter mechanism of claim 1, said body being annular, said cover assembly including an elongated body portion mounted upon said body and secured thereto, overlying said pump.

5. In the hand pump adapter mechanism of claim 4, said body portion including a depending tube projecting into and anchored within said body in communication with said air chamber.

6. In the hand pump adapter mechanism of claim 1, said bladder having a wall of decreasing thickness towards its outer and whereby the bladder flexes axially away from the bottom of the container until all liquids are dispensed therefrom.

7. In the hand pump adapter mechanism of claim 1, the outlet of said extension tube being flared outwardly.

8. In the hand pump adapter mechanism of claim 7, end portions of the bladder when uninflated being nested within the outlet of said extension tube.

9. In the hand pump adapter mechanism of claim 1, said body at its top having a pair of opposed outwardly directed top handles; and at its bottom a single outwardly directed bottom handle underlying one of said top handles.

10. In the hand pump adapter mechanism of claim 9, said flexible outer wall extending between said top and bottom handles and of a convex shape.

11. In the hand pump adapter mechanism of claim 1, said cap portion having an axial threaded bore communicating with said extension tube; and an apertured plug threaded into said bore, upon retraction providing escape of pressurized air from said bladder for storage and to selectively facilitate refilling the container with liquids and semi-liquids through said dispensing outlet.

12. In the hand pump adapter mechanism of claim 1, a cup shaped extension depending from said body to supportively receive the bottom of a glass bottle.

* * * * *

UNITED STATES PATENT AND TRADEMARK OFFICE

CERTIFICATE OF CORRECTION

PATENT NO. : 4,763,818

DATED : August 16, 1988

INVENTOR(S) : Alfonso Di Stefano and Gerald A. Farber

It is certified that error appears in the above-identified patent and that said Letters Patent is hereby corrected as shown below:

Front Page, No. 76, cancel "Alfonso D. Stefano" and substitute --Alfonso Di Stefano--.

In the specification:

Column 1, line 8, cancel "The adaptor" and substitute --The adapter--.

Column 3, line 39, cancel "inner and" and substitute --inner end--; and line 54, cancel "surround" and substitute --surrounds--.

Column 4, line 33, cancel "embodiment the" and substitute --embodiment, the--.

In the claims:

Column 6, line 27, cancel "outer and" and substitute --outer end--.

Signed and Sealed this

Seventeenth Day of January, 1989

*Attest:*

DONALD J. QUIGG

*Attesting Officer*

*Commissioner of Patents and Trademarks*